US005188894A

United States Patent [19]

Yamada et al.

[11] Patent Number: 5,188,894

[45] Date of Patent: Feb. 23, 1993

[54] COMPOSITE CARBON FIBER AND PROCESS FOR PREPARING SAME

[75] Inventors: Yasuhiro Yamada, Saga; Hidemasa Honda, Tokyo; Haruki Yamasaki, Kanagawa; Susumu Shimizu, Tokyo, all of Japan

[73] Assignees: Tanaka Kikinzoku Kogyo K.K.; The Agency of Industrial Science and Technology, Japan

[21] Appl. No.: 575,955

[22] Filed: Aug. 31, 1990

[30] Foreign Application Priority Data

Aug. 31, 1989 [JP] Japan ..... 1-226511
Nov. 10, 1989 [JP] Japan ..... 1-293457

[51] Int. Cl.[5] ..... D02G 3/00

[52] U.S. Cl. ..... 428/370; 428/364; 428/367; 428/373; 428/374; 423/447.1; 423/447.2; 264/211.11

[58] Field of Search ..... 428/373, 367, 374; 423/447.1, 447.2; 264/211.11

[56] References Cited

U.S. PATENT DOCUMENTS

| | | | |
|---|---|---|---|
| 4,014,725 | 3/1977 | Schulz | 423/447.1 |
| 4,504,454 | 3/1985 | Riggs | 423/447.1 |
| 4,628,001 | 12/1986 | Sasaki et al. | 428/367 |
| 5,037,697 | 8/1991 | Fujisawa | 428/373 |

*Primary Examiner*—Patrick J. Ryan
*Assistant Examiner*—J. M. Gray
*Attorney, Agent, or Firm*—Klauber & Jackson

[57] ABSTRACT

Disclosed herein is curled or uncurled composite carbon fiber which comprises part of optically isotropic carbon fiber and balance of optically anisotropic one and a process for preparing the same. The composite carbon fiber possesses the excellent characteristics by complementing the respective defects by means of the respective characteristics of the both kinds of the carbon fiber.

4 Claims, 2 Drawing Sheets

COMPOSITE CARBON FIBER AND PROCESS FOR PREPARING SAME

TECHNICAL FIELD

The present invention relates to composite carbon fiber and a process for preparing same.

BACKGROUND ART

Carbon fiber is broadly divided into pan-based and pitch-based fiber.

Currently, the PAN-based carbon fiber industrially manufactured by sintering acrylonitrile under the specific conditions is utilized as high-strength material (HP type). Since, however, the PAN-based fiber possesses low carbon content, a decomposition gas may be evolved and the yield is as low as 50 to 55%. Further, since the graphite structure in a high temperature is difficult to be developed, it is difficult to prepare carbon fiber with high modulus of elasticity though it is rather easy to prepare high strength products.

On the other hand, since the pitch-based carbon fiber is manufactured employing the pitch of coal and petroleum as raw material, the carbon content of spun fiber is as high as about 95% and the yield is also as high as 80 to 85%. Further, since the PAN-based carbon fiber is excellently characterized in its physical property by the occurrence of high modulus of elasticity, its development has been rapidly advanced.

Even for the pitch-based carbon fiber, when pitch is melted, spun and sintered as it is, the carbon fiber of optical isotropy can be obtained. The carbon fiber thus obtained is utilized as broadly employed carbon fiber (GP products) for reinforcing material of a structure because it is inexpensive and produces constant strength. The carbon fiber bearing optical anisotropy (mesophase) is to possess high modulus of elasticity (HM type) by spinning pitch having crystallizability because liquid crystals are arranged in the direction of a fiber axis in a shearing stress field during the spinning and huge graphite crystals can be produced by carbonizing the crystals.

Accordingly, product application being in conformity with these respective characteristics has been promoted; the carbon fiber simple substance is utilized as a filter, a catalyst, an electromagnetic shielder and the like; the carbon fiber in the composite material is utilized as reinforcing material of a matrix of a resin, a metal, carbon, ceramics and the like broadly in the field of the universe, aviation, leisure, sports, industry and the like.

The research has been advanced for employing the carbon fiber in combination with engineering plastics as electronic parts, automobile parts and structural material.

However, the tensile strength of the optically isotropic carbon fiber of these pitch-based carbon fiber is as low as 50 kg/mm to 100 kg/mm while the elongation rate thereof is as high as 2.5%. Although, on the other hand, the optically anisotropic carbon fiber has been obtained having the tensile strength of net less than 250 kg/mm and the modulus of elasticity of net less than 50 ton/mm, its elongation rate is about 0.5%.

However, in case that the carbon fiber is employed with a thermoplastic as composite material, a thermoplastic is ductile material and the reinforcing carbon fiber is small in ductility though it possesses large tensile strength and large modulus of elasticity so that the composite material exhibits the behavior of brittle material. Therefore, once a crack is generated, it is likely to invite final destruction to cause a large accident so that it is a severe problem how to elevate destruction tenacity for eliminating danger. The main of destruction of these plastics reinforced with the carbon fiber include destruction of a matrix, peeling of the fiber from the matrix, rupture of the fiber, pulled-out of the fiber and the like. Although actual destruction seems to occur by means of the combination thereof, among them the peeling between the fiber and the matrix and the pulled-out of the fiber are the main factors. Further, it is nearly impossible to employ the carbon fiber composite as an elastic body.

The reasons thereof may be that the carbon fiber is material of high linearity and that the surface of the carton fiber is so smooth that the bonding at the interface becomes a problem, and so on.

When the carbon fiber is employed as a simple substance, it is necessary to provide much more surface area and much more space in a constant volume of a filter, a catalyst and a like. Since the conventional carbon fiber is linear, it is molded with a binder for making a space after the fiber is woven as a net or piled like a mat. It is rather difficult to keep the space constant by employing the nets even if the woven ones are superposed. It is much more difficult to form a structural body provided with a constant cavity. The fiber is not at all employed in an application requiring a elastic structure.

Although the fiber fabric of the optically anisotropic carbon fiber can be formed as a radial structure, an onion structure, a random structure or a composite structure thereof by controlling the spinning conditions and the tensile strength, the modulus of elasticity, the elongation rate and the like can be changed by changing a hoat-treatment temperature, it is difficult to raise the elongation rate by more than 1% in all the instances.

Moreover, there arises a problem that the compression strength of the anisotropic carbon fiber is low. This is because the fabric of this fiber comprises broad carbon layers of which a face is aligned to parallel to fiber, and the strength of an a-axis and a b-axis of the carbon layer is high and that of a c-axis is low. Accordingly, in order to solve the problem, it is necessary to form a narrow carbon layer face as a PAN-based carbon fiber or to essentially change the texture of the optically anisotropic carbon fiber.

SUMMARY OF INVENTION

Accordingly, it is an object of the present invention to provide composite carbon fiber free from the above problems.

It is another object of the invention to provide carbon fiber possessing the characteristics of the optically isotropic and anisotropic carbon fibers.

It is a further object of the invention to provide composite carbon fiber useful as a composite for a structural element and having a different structure from a sectional structure of conventional optically anisotropic carbon fiber.

It is a still further object of the invention to provide composite carbon fiber possessing high modulus of elasticity, high strength and high stretchability which are not obtained by the conventional carbon fiber.

It is a still further object of the invention to provide a process for preparing the composite carbon fiber having the above characteristics.

One aspect of the invention is curled pitch-based carbon fiber which comprises part of optically isotropic carbon fiber and balance of optically anisotropic one, the carbon fiber being curled in a direction of the fiber.

A second aspect of the invention is uncurled pitch-based carbon fiber which comprises part of optically isotropic carbon fiber and balance of optically anisotropic one, the carbon fiber being curled in a direction of the fiber.

A third aspect of the invention is a process for preparing pitch-based carbon fiber which comprises separately proving two kinds of pitch one of which can produce optical isotropy and the other of which can produce optical anisotropy to a spinning apparatus, melting and spinning them together from a spinning aperture, conducting infusibilization treatment to the obtained fiber and heat-treating the fiber.

The composite carbon fiber of this invention comprises as mentioned before, in its fiber section, part of optically isotropic carbon fiber and balance of optically anisotropic one which produces the excellent characteristics by complementing the respective defects by means of the respective characteristics of the both kinds of the carbon fiber.

Namely, the invention is to provide a pitch-based composite carbon fiber which keeps the strength, the modulus of elasticity and the stretchability of the fiber as a whole by maintaining the stretchability the characteristic of the optically isotropic carbon fiber while elevating the weakness of the strength by means of the high tensile strength and the high modulus of elasticity, the characteristics of the optically anisotropic carbon fiber.

When one of the both kinds of the carbon fiber is partially embraced by the other, the composite carbon fiber is spirally curled in a direction of fiber with a certain modulus of curvature because the contraction of the optically isotropic carbon fiber is large and that of the optically anisotropic one is small. Since, accordingly, the carbon fiber possesses high bulkiness, high elasticity and an excellent contraction and expansion property, the carbon fiber can be formed into a filter, a catalyst and the like without weaving a net or piling like mats which is required in the conventional carbon fiber. The exfoliation between the pitch-based carbon fiber and the matrix material is difficult to occur because the compatibility of the carbon fiber to the matrix material is excellent when the fiber is employed for manufacture of the composite.

According to the process for preparing the composite carbon fiber of the invention, the composite carbon fiber possessing the above characteristics can be readily manufactured, and various carbon fibers having different ratio of optically isotropic carbon fiber and optically anisotropic carbon fiber and different orientation can be also readily manufactured.

As apparent from the foregoing, since the composite carbon fiber according to the present invention comprises part of optically isotropic carbon fiber and balance of optically anisotropic one and the said carbon fiber is curled in the direction of the fiber, the weakness of the strength which is the defect of optical isotropy is complemented by the high strength and which modulus of elasticity which are the advantages of optical isotropy, and the poor stretchability of the latter is complemented by the former so that the respective advantages are incorporated therein and complement the respective defects to prepare the composite carbon fiber having high elasticity, high strength and high stretchability which has not been heretofore obtained and is useful material as composite material of a structural element and the like.

When one of the both kinds of the carbon fiber is partially embraced by the other, the composite carbon fiber is usually curled in a direction of fiber with a certain modulus of curvature so that the fiber possesses high bulkiness, high elasticity and a high degree of shrinkage so that a filter, a catalyst and the like can be prepared from the carbon fiber without knitting a net and piling them like mats which have been required for a conventional fiber. When the fiber is employed with matrix material for the manufacture of a composite, the exfoliation of the pitch-based carbon fiber and the matrix material is difficult to take place because the compatibility of the fiber to the matrix material is excellent. Accordingly, the carbon fiber is considerably useful material for preparing composite material with electroconductive material having shrinkage property, an elastic packing, plastics, a metal, carbon, and the like.

According to the above process for preparing the pitch-based carbon fiber, the pitch-based carbon fiber possessing the above excellent properties can be easily prepared. Further, by preparing the fiber employing the various sectional shapes of the spinning opening at the front of the spinning aperture, various pitch-based carbon fibers can be suitably obtained which possess different ratio and orientation of optically isotropic carbon fiber and optically anisotropic carbon fiber in the fiber section.

Although the spinning of lint is described in the above Example, a large volume of inexpensive curled fiber can be also prepared by spinning the pitch in accordance with a spinning method and a stable spinning method employing a gas pressure.

DETAILED DESCRIPTION OF INVENTION

The carbon fiber of this invention can be prepared from such starting material as heavy oil and heavy bituminous material, in general, coal tar, petroleum decomposition tar and steam cracker tar having in their respective molecules many aromatic ring structures. Although the most suitable material is selected from these materials considering purity and chemical composition, these materials may be pretreated by solvent extraction, heat modification and the like if no materials meeting the requirements are found. After meso carbon ultrafine spheres are formed which sufficiently adsorb free carbon, fine particles of minerals and ultra-fine solids, the spheres are eliminated by extraction filtration. Optically isotropic pitch can be obtained after the pitch obtained by concentrating the above filtrate is secondary heat-treated and condensation-polymerized together with eliminating lighter substances.

On the other hand, optical anisotropic pitch can be obtained as follows. The pitch is diluted with tetrahydroquinoline to three to four times volume, and hydogenated in a solvent at a temperature of 400 to 450 degree and an auto-generated atmosphere of 10 to 30 kgf/cm$^2$. After the pitch is filtrated and free carbon is sufficiently eliminated, the solvent is removed. The pitch is finally heat-treated at a temperature of 450 to 500 degree to obtain the optically anisotropic (mesophase) pitch.

Mesophase pitch can be obtained by another method by thermally treating heavy tar by produced during the manufacture of gasoline by means of a fluid catalytic cracking process of light oil to form the mesophase while a softening point is controlled by eliminating lighter substances so that optically isotropic pitch can be obtained.

The properties of carbon fibers prepared from thus obtained optically isotropic pitch and optically anisotropic pitch are different. When, in general, the optically isotropic pitch is spun to make carbon fiber, the graphite crystals in the fiber after carbonization become fine so that orientation in a direction of a fiber axis becomes bad. Said carbon fiber is named as broadly employed type (GP product) and generally its tensile strength is around 100 kg/mm$^2$ and its modulus of elasticity is around 5 ton/mm$^2$. In case of the optically anisotropic pitch, it is important to suitably control the orientation of the molecules as well as to suitably prepare the raw material pitch especially for obtaining the carbon fiber having high strength and high elasticity. The orientation is affected by a spinning temperature, a nozzle shape and the molecular orientation control. Accordingly, the mechanical characteristics vary in a broad range according to the conditions. The tensile strength of the carbon fiber currently obtained is 300 to 500 kg/mm$^2$ and the modulus of elasticity is 30 to 70 ton/mm$^2$.

The modulus of heat expansion of the optically isotropic carbon fiber is $4\times10^{-6}$/K, while that of the optically anisotropic one is $2\times10^{-6}$/K which is half of that of the former.

As mentioned earlier, the present invention can provide the curled carbon fiber possessing the completely new characteristics by combining the considerably different two pitches.

DESCRIPTION OF PREFERRED EXAMPLE

A preferred Example of this invention will be hereinafter described referring to the annexed drawings.

Figure 1:
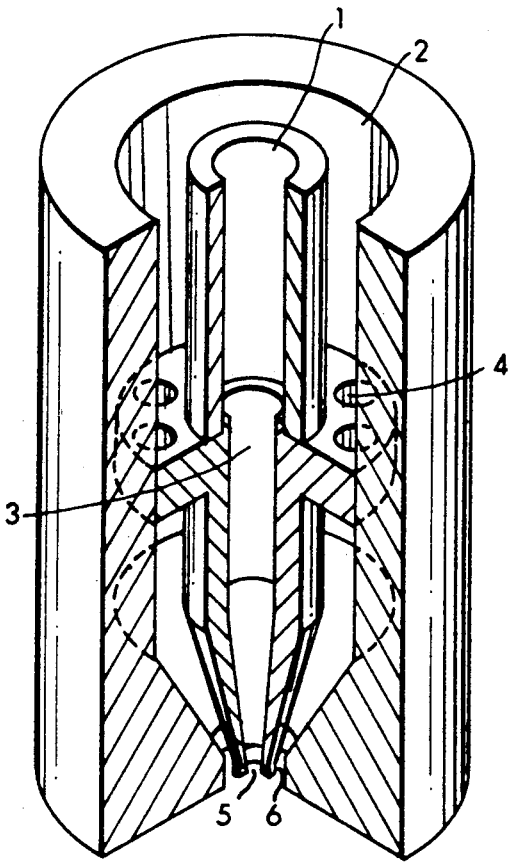
FIG. 1 is a broken perspective view showing an apparatus employed for preparation of the pitch-based carbon fiber of the present invention.

Coal tar pitch as starting material of carbon fiber was heated at 400° C. under an inert gas atmosphere, and free carbon and ultrafine solids were filtrated. Thus obtained filtrate was concentrated to obtain pitch which was then condensation-polymerized by the second heat treatment at 400° C. and was simultaneously eliminated of lighter substances to provide optically isotropic pitch (softening point: 232° C.). The optically isotropic pitch was diluted with about three times volume of tetrahydroquinoline, was hydrogenated at a temperature of 430° C. and under a pressure of 20 kgf/cm$^2$, was filtrated for eliminating free carbon and the like, was desolvated, and was further heat treated at a temperature of 470° C. to provide optically anisotropic pitch (softening point: 267° C.). The above optically isotropic pitch and the optically anisotropic pitch were separately introduced to a spinning apparatus depicted in FIG. 1. The optically isotropic pitch was supplied through a passage 1 and the optically anisotropic pitch was supplied through a passage 2 so that they were flown into respective discharge apertures 5,6 through introducing paths 3,4 to be melt-spun to carbon fiber which was then rolled around a spinning drum at a rolling speed of 100 m/min.

Thereafter, the carbon fiber was treated for infusibilization, and was sintered in a sintering furnace at 1000° C. and 2600° C.

Figure 2:
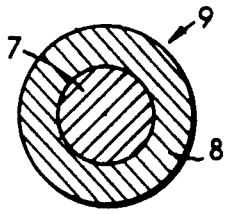
FIG. 2 is a horizontal sectional view showing an example of the pitch-based carbon fiber of the present invention, FIG. 3(*a*) to (*i*) show various examples of horizontal sections of the pitch-based carbon fiber of this invention.
Figure 3A:
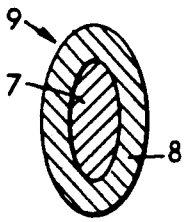
Figure 3B:
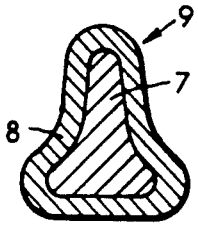
Figure 3C:
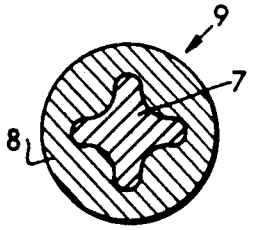
Figure 3D:
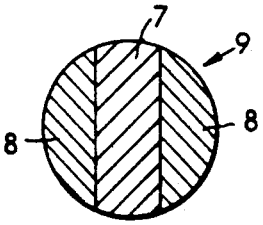
Figure 3E:
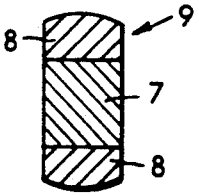
Figure 3F:
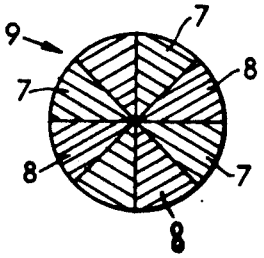
Figure 3G:
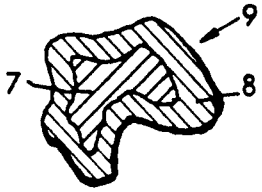
Figure 3H:
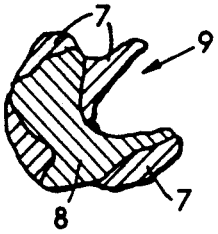
Figure 3I:
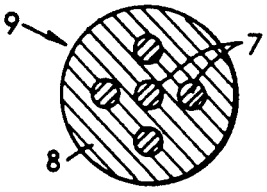
Figure 4:
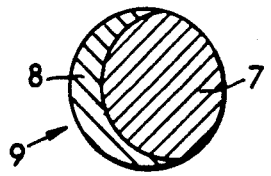
FIG. 4 is a horizontal sectional view showing another example of the pitch-based carbon fiber of the present invention, and FIG. 5(*a*) to (*g*) show various examples of horizontal sections of the pitch-based carbon fiber of this invention.
Figure 5A:
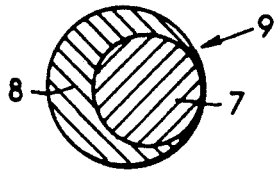
Figure 5B:
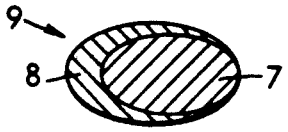
Figure 5C:
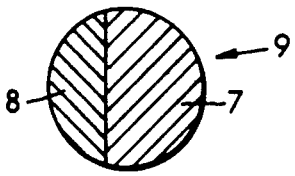
Figure 5D:
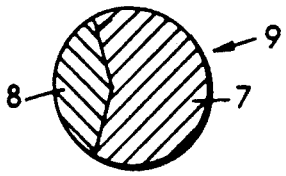
Figure 5E:
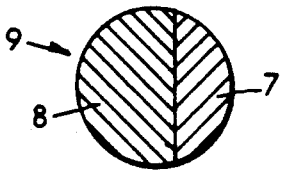
Figure 5F:
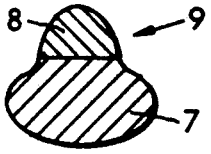
Figure 5G:
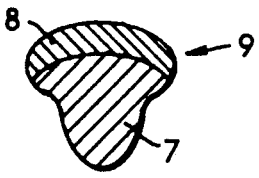

The horizontal section of the carbon fiber at the present stage is as shown in FIG. 2 or FIG. 4, and a piece of carbon fiber 9 in FIG. 2 was composed of an optically isotropic carbon fiber 7 and an optically anisotropic carbon fiber 8 joined together the former 7 of which was embraced of its entire circle by the latter 8, and a piece of carbon fiber 9 in FIG. 4 was composed of an optically isotropic carbon fiber 7 and an optically anisotropic carbon fiber 8 joined together the former 7 of which was embraced of its semicircle by the latter 8.

The composite carbon fiber 9 in FIG. 2 possesses a diameter of 10 μm, an elongation rate of 0.9%, strength of 320 kg/mm$^2$ and a modulus of elasticity of 36 ton/mm$^2$. The elongation rate, the strength and the modulus of elasticity obtained by the composite carbon fiber cannot be obtained by a conventional one. The fibers in FIG. 4 of which a diameter was 10 μm and of which modulus of curvature was about 3 mm $\phi$ to 5 mm $\phi$ exhibited about 200% of a degree of shrinkage in the direction of the fiber axis. It was confirmed that a compression recovery ratio was 100% when the bundles were randomly compressed as a block to its 90% volume compared with its original volume.

It was also confirmed that when the block of the compressed fiber in FIG. 4 was placed in a vessel, it was employed for such as a filtration filter as it was without further procedure and without being formed as a net or a mat because the bundle was fixed by the elasticity of the fiber.

A rubber-like carbon fiber composite which cannot be heretofore produced can be produced by combining the above carbon fiber with plastic material. Elastic material having wear characteristics such a packing can be prepared.

When the composite carbon fiber is prepared by employing the different spinning apparatus having various sectional shapes of the spinning opening at the front of the spinning aperture, various pitch-based carbon fibers 9 can be obtained which possess different ratio and orientation of optically isotropic carbon fiber 7 and optically anisotropic carbon fiber 8 in the fiber section as shown FIG. 3(*a*) to (*i*) and FIG. 5(*a*) to (*g*).

Although the composite carbon fiber of which an outer part is optically anisotropic and of which an inner part is isotropic has been described in the Example referring to FIGS. 2 and 3, the invention is not restricted thereto, that is, the composite carbon fiber of which outer part is optically isotropic and of which an inner part is optically anisotropic is included in the present invention.

What is claimed is:

1. A melt-spun composite carbon fiber which is comprised of an optically isotropic carbon fiber joined to an optically anisotropic carbon fiber, having been separately formed by melt-spinning and being continuously brought into surface contact with each other.

2. The composite carbon fiber of claim 1 wherein the optically anisotropic carbon fiber substantially encloses the optically isotropic carbon fiber.

3. The composite carbon fiber of claim 1 wherein said composite carbon fiber is curled.

4. The composite carbon fiber of claim 3 wherein each of said optically anisotropic carbon fiber and optically isotropic carbon fiber is partially externally exposed, with said composite carbon fiber being caused to curl thereby.

* * * * *